US007603977B2

(12) United States Patent
Heidrich et al.

(10) Patent No.: US 7,603,977 B2
(45) Date of Patent: Oct. 20, 2009

(54) COOLING DUCT PISTON FOR AN INTERNAL COMBUSTION ENGINE COMPRISING HEAT PIPES

(75) Inventors: Peter Heidrich, Sensweiler (DE); Roland Lochmann, Marbach (DE); Timo Estrum, Stuttgart (DE)

(73) Assignee: Mahle International GmbH, Stuttgart (DE)

( * ) Notice: Subject to any disclaimer, the term of this patent is extended or adjusted under 35 U.S.C. 154(b) by 74 days.

(21) Appl. No.: 11/659,986

(22) PCT Filed: Aug. 10, 2005

(86) PCT No.: PCT/DE2005/001411

§ 371 (c)(1),
(2), (4) Date: May 4, 2007

(87) PCT Pub. No.: WO2006/015585

PCT Pub. Date: Feb. 16, 2006

(65) Prior Publication Data

US 2007/0251487 A1 Nov. 1, 2007

(30) Foreign Application Priority Data

Aug. 11, 2004 (DE) ..... 10 2004 038 946

(51) Int. Cl.
*F02F 3/22* (2006.01)

(52) U.S. Cl. ..... 123/193.6

(58) Field of Classification Search ..... 123/193.6, 123/41.35, 41.2; 92/186
See application file for complete search history.

(56) References Cited

U.S. PATENT DOCUMENTS

| | | | | |
|---|---|---|---|---|
| 4,470,375 | A * | 9/1984 | Showalter | 123/41.35 |
| 4,493,292 | A * | 1/1985 | Showalter | 123/41.2 |
| 5,454,351 | A | 10/1995 | Cao et al. | |
| 5,778,533 | A | 7/1998 | Kemnitz | |
| 6,698,392 | B1 | 3/2004 | Köhnert et al. | |
| 6,701,875 | B2 * | 3/2004 | Weng et al. | 123/41.35 |
| 2007/0113802 | A1 * | 5/2007 | Mihara | 123/41.35 |

FOREIGN PATENT DOCUMENTS

| | | | |
|---|---|---|---|
| DE | 24 24 882 | A1 | 12/1975 |
| DE | 28 50 762 | A1 | 6/1980 |
| DE | 32 05 173 | A1 | 8/1983 |
| EP | 0 799 373 | B1 | 10/1997 |
| FR | 2 126 483 | A | 10/1972 |
| JP | 62 168955 | A | 7/1987 |
| SU | 572 106 | A1 | 3/1986 |
| WO | WO 96/20340 | | 7/1996 |
| WO | WO 2004/029443 | A | 4/2004 |

* cited by examiner

*Primary Examiner*—M. McMahon
(74) *Attorney, Agent, or Firm*—Collard & Roe, PC.

(57) ABSTRACT

The invention relates to a cooling duct piston for an internal combustion engine comprising heat pipes. In order to improve dissipation of heat from the thermally loaded piston areas while preventing thermal tensions, liquid-filled heat pipes that are provided with an evaporator end and a condenser end are disposed in bores of the cooling duct which are oriented towards the bottom of the piston. The heat pipes are arranged such that the evaporator ends terminate at the end of the bores which faces the piston bottom while the condenser ends terminate in the closed cooling duct.

8 Claims, 3 Drawing Sheets

COOLING DUCT PISTON FOR AN INTERNAL COMBUSTION ENGINE COMPRISING HEAT PIPES

CROSS REFERENCE TO RELATED APPLICATIONS

Figure 1:
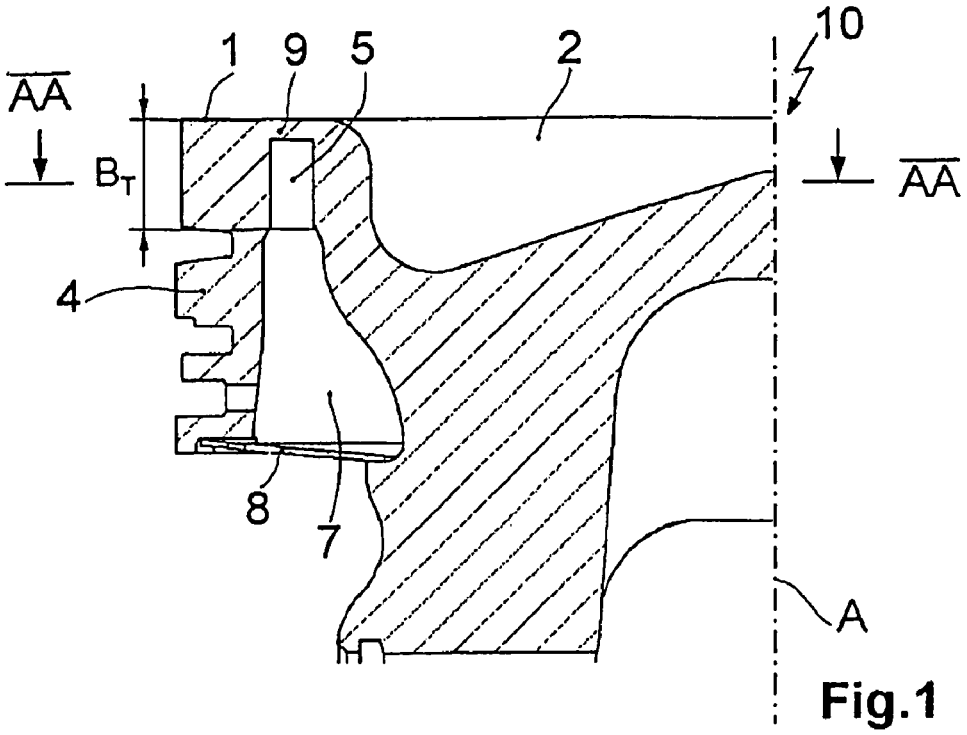

Applicants claim priority under 35 U.S.C. §119 of German Application No. 10 2004 038 946.2 filed Aug. 11, 2004. Applicants also claim priority under 35 U.S.C. §365 of PCT/DE2005/001411 filed Aug. 10, 2005. The international application under PCT article 21(2) was not published in English.

The invention relates to a cooling channel piston for an internal combustion engine having heat pipes, having a piston head forged from steel, which comprises a combustion bowl in the piston crown, a ring wall with ring belt, as well as a cooling channel that runs on the circumference at the height of the ring belt, which can be closed off by means of a cover, whereby a plurality of bores are disposed in the cooling channel, distributed over its circumference, directed towards the piston crown, and which has a piston skirt that is connected with pin bosses suspended on the piston head.

Steel pistons of the type stated have not become known up to this time. From WO 2004/029443 A1, only a cooling channel piston of steel is known, in which an improvement in the cooling and shape stability of the piston is supposed to be achieved in that the cooling channel has bores directed towards the piston crown.

Light-metal pistons for an internal combustion engine are described in U.S. Pat. No. 5,454,351 and DE 32 05 173 A1, which uses so-called Heat Pipes, in other words heat pipes, for carrying heat away from the hot piston regions, which, sealed off to be air-tight and pressure-tight, contains an easily evaporating cooling fluid, such as preferably water or also ammonia, glycol, or the like. The heat pipes, which consist of copper, are inserted or cast into bores that are evenly distributed on the circumference and made in the piston crown region on the crankshaft side, whereby the bores extend all the way to the height of the ring belt. In the region of the pin bosses, the heat pipes are structured to be slightly bent, in order to allow assembly of the piston pin into the piston. The method of effect of the heat pipes, which is actually known, consists in evaporation of the fluid situated in the heat pipe on the "hot" side—evaporator side—by means of absorption of the heat of the region to be cooled. The steam components formed flow to the "cold" side—condenser side—of the heat pipe, where they go back into the liquid state, giving off their latent heat of evaporation, due to the temperature gradient between hot and cold side. On the cold side, the heat of evaporation is transported out of the crankshaft chamber of the internal combustion engine by means of spraying on cooling oil. In order to guarantee such removal of the heat in the case of a plurality of individual heat pipes, it is necessary to spray all of the heat pipes, and this results in a complicated and cost-intensive piston design.

The invention is based on the task of structuring a cooling channel piston of the type stated initially, in such a manner that improved heat removal from the heat-stressed piston regions is achieved, and thereby the occurrence of thermal stresses is prevented.

This task is accomplished, according to the invention, in that liquid-filled heat pipes provided with an evaporator and condenser side are disposed in the bores of the cooling channel, whereby the arrangement takes place in such a manner that the evaporator sides end at the piston-crown-side end of the bores, and the condenser sides end in the closed cooling channel.

Because the condenser sides end in the closed cooling channel, effective and rapid heat removal, independent of the piston position, particularly between upper dead point and lower dead point, is achieved at the condenser-side end of the heat pipe, so that an approximately uniform temperature distribution along the piston bowl edge is achieved, thereby effectively preventing crack formations at the piston crown and bowl edge of the combustion bowl, due to thermal stresses.

Practical embodiments of the invention are the object of the dependent claims.

Figure 2:
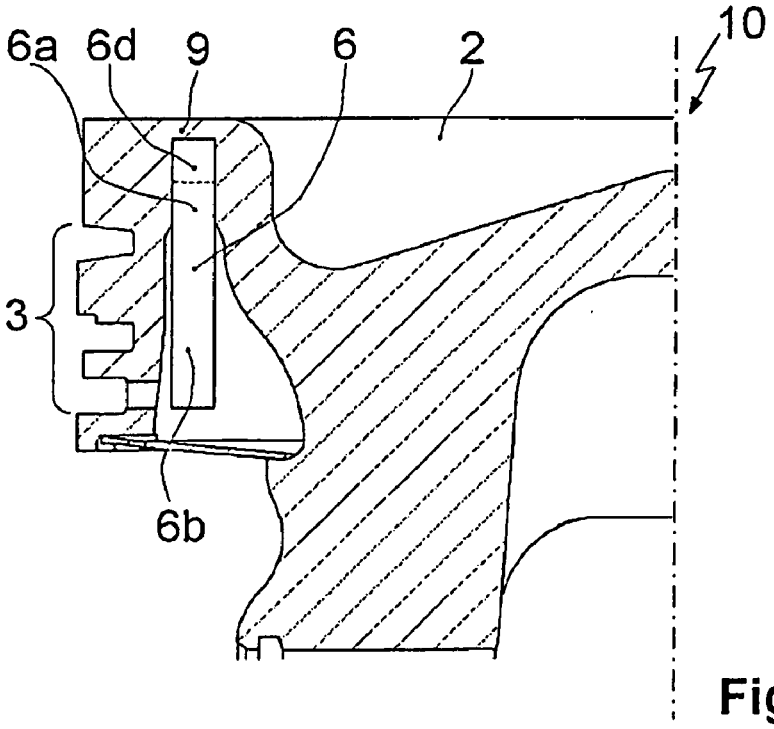
Figure 3:
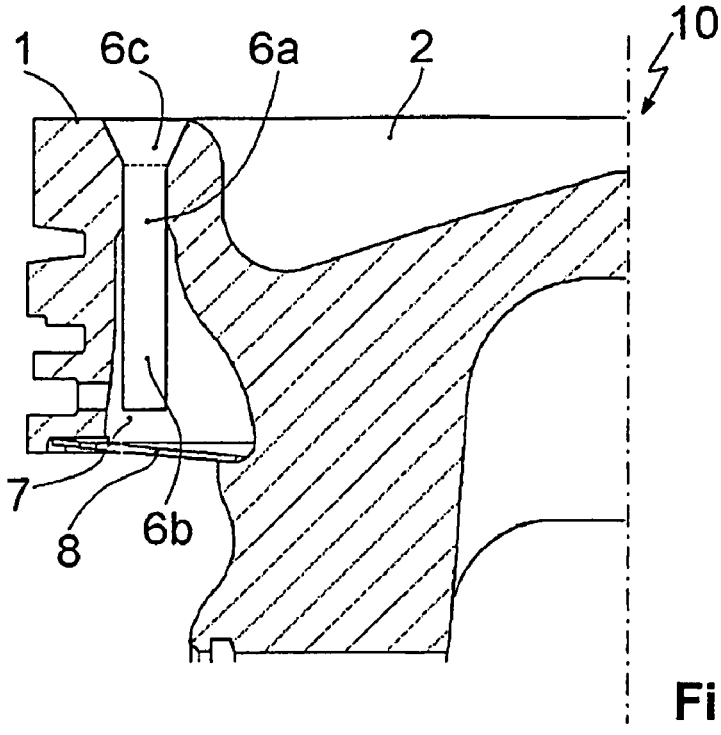
Figure 4:
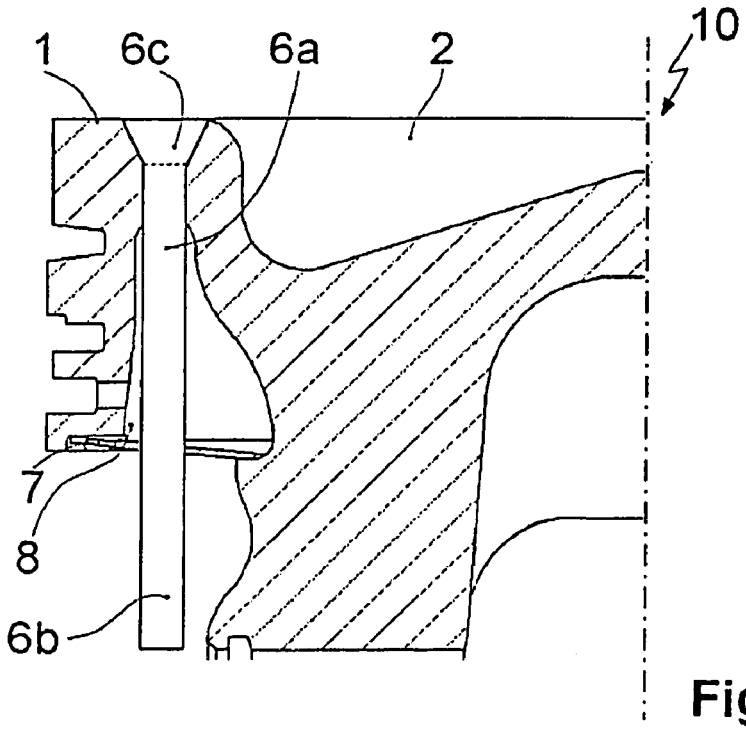
Figure 5:
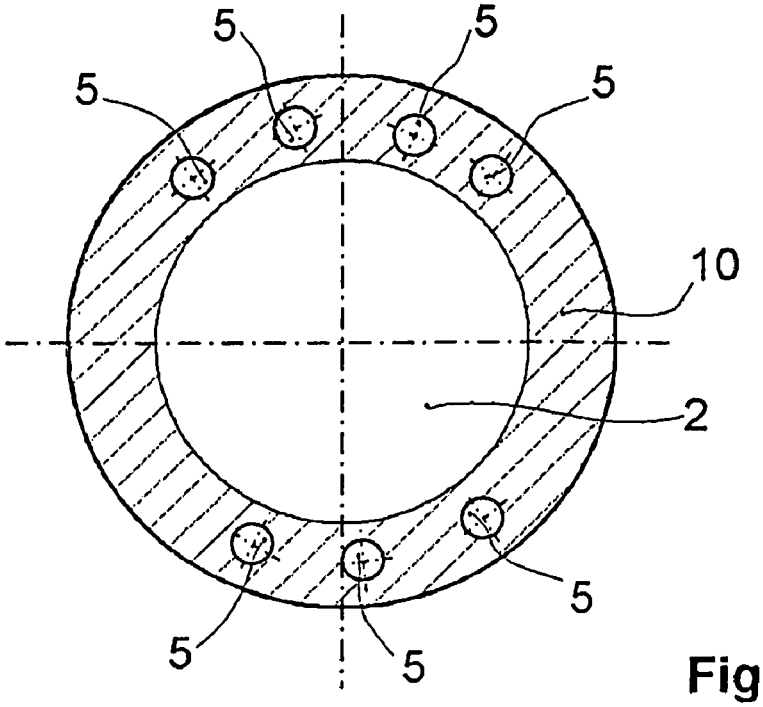
Figure 6:
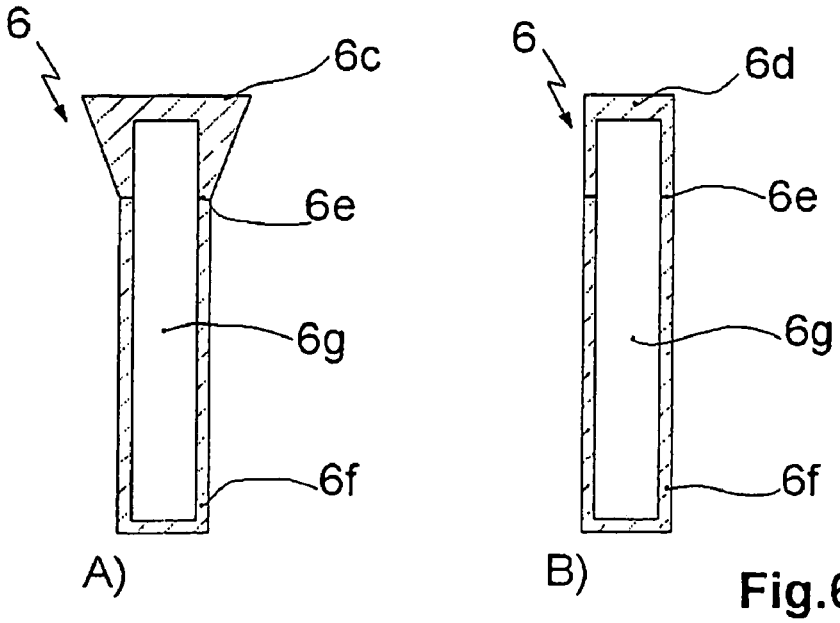

An exemplary embodiment of the invention will be described below, using the drawings. These show FIG. 1 a half-side sectional representation of a piston head with cooling channel representation;

FIG. 2 a half-side sectional representation of a piston head with cooling channel and heat pipe in a first arrangement according to the invention;

FIG. 3 a half-side sectional representation of a piston head with cooling channel and heat pipe in a second arrangement according to the invention;

FIG. 4 a half-side sectional representation of a piston head with cooling channel and heat pipe in a third arrangement according to the invention;

FIG. 5 a sectional representation along the line AA according to FIG. 1;

FIG. 6 A) a sectional representation of a heat pipe in a first embodiment;

FIG. 6 B) a sectional representation of a heat pipe in a second embodiment.

The one-piece cooling channel piston having heat pipes, according to the invention, consists of a forged piston head 10 made of steel, having a combustion bowl 2 in its piston crown 1, a ring wall 4 with ring belt 3, a closed cooling channel 7 that runs around the circumference at the height of the ring belt, as shown in FIG. 1. A piston skirt is connected with the bosses suspended on the piston head, analogous to the representation of the figures according to WO 2004/029443 A1. The production of the forged piston takes place according to the method according to EP 0 799 373 B1, whereby bores 5 are provided in the cooling channel 7, which are disposed distributed over the circumference in accordance with the impact of the combustion jets, and in the direction of the piston crown, i.e. parallel to the piston axis A, as is evident from the sectional representation according to FIG. 5. Closing of the cooling channel takes place by means of a cover 8 provided with a cooling oil inlet and outlet. The depth $B_T$ of the bores 5 is designed in such a manner that a wall ridge 9 between piston crown 1 and crown-side end of the bores 5 is formed.

As shown in FIGS. 6 A) and B), heat pipes 6, referred to as so-called Heat Pipes, have a steel mantle and are formed from a cylindrical lower part 6*f* and a head part 6*c* that is either conical or cylindrical. Head part and lower part have a cylindrical cavity in their interior, which cavity is evacuated and filled with a certain amount of coolant 6*g*, for example water. The coolant, particularly water, must be de-gassed before filling, under vacuum, at a pressure of $10^{-4}$ to $10^{-5}$ bar, in order to prevent cavitation due to the piston movement in the internal combustion engine, since the coolant is accelerated to the opposite side at the reversal points of the piston, whereby imploding gas bubbles with accompanying cavitation can occur. It is practical if the heat pipes are maximally filled with coolant up to half of their volume. Head part 6*c* and lower part 6*f* of the heat pipes 6 are connected with one another in air-tight manner, by way of the connection surface 6*e*. In the case of heat pipes configured in this manner, the evaporator side is referred to as the hot side with 6*a*, and the condenser side is referred to as the cold side with 6*b*.

The diameters of the heat pipes 6 amount to approximately 3 to 10% of the piston diameter ($D_{piston}$) and the total length to approximately 20 to 50% $D_{piston}$, depending on the exemplary embodiments according to FIGS. 2/3 or FIG. 4.

According to a first exemplary embodiment according to the invention, according to FIG. 2, the heat pipes 6 filled with coolant, according to FIG. 6B), having a cylindrical head part, are introduced into the bores 5 in such a manner that the evaporator sides 6*a* end at the piston-crown-side end of the bores 5, and the condenser sides 6*b* end in the closed cooling channel 7. The heat flow therefore takes place from the piston crown 1 by way of the wall ridge 9 and the outer steel mantle of the evaporator side 6*a* to the interior wall of the steel mantle, and evaporates the coolant, with absorption of the heat. The steam components formed flow to the condenser side 6*b* of the heat pipes 6, where they go back into the liquid state, giving off their latent heat of evaporation, due to the temperature gradient between evaporator side and condenser side. Transfer of heat takes place to the cooling oil situated in the cooling channel, and from there is transported to the cooling oil outlet as a result of the shaker movement. Since the condenser sides 6*b* are disposed in the cooling channel, a uniform heat transfer to the cooling oil situated there is implemented, thereby making it possible to prevent the formation of thermal stresses at the piston, to a great extent.

As a further variant of this embodiment, the use of the bores 5 made in the piston head 10 as a cylindrical head piece 6*d* can also be considered, which is connected with a lower heat pipe part 6*f* that is attached to the cooling-channel-side end of the bore 5 by means of a friction-welding connection, screw connection, or glue connection. In the case of the heat pipes produced in such a manner, the bore 5 thereby forms the evaporator side 6*a*, and the friction-welded lower part 6*f* forms the condenser side 6*b* of the heat pipes.

In a second exemplary embodiment according to FIG. 3, the head parts 6*c* of the heat pipes 6 are configured conically. The bores 5 made in the cooling channel 7 towards the piston crown 1 run all the way to the piston crown as a continuous bore, which are also configured conically in the region of the piston crown, for accommodating the heat pipes 6. In the inserted state of the heat pipes into the bores 5, the upper crown surface of the evaporator sides 6*a* also forms part of the piston crown itself, thereby implementing heat removal, as described above, in particularly effective manner. Here, the condenser sides 6*b* also end in the cooling oil of the cooling channel 7.

In a third exemplary embodiment according to FIG. 4, in which the evaporator sides 6*a* also form part of the piston crown 1, the condenser sides 6*b* end in the crankshaft-side end of the engine chamber, using conical head parts, i.e. the heat pipes are guided through the cover 8 of the cooling channel and sprayed by one or more cooling oil nozzles disposed there (not shown). In this way, the result is achieved that not all of the amount of heat absorbed on the combustion chamber side is given off only to the cooling oil situated in the cooling channel 7, and therefore remains in the piston head 10, but rather the main part of the amount of heat is transported away from the piston head 10.

In order to implement a low heat transfer resistance between heat pipes 6 and piston head 10, these preferably consist of the same steel material, whereby the bores 5 and the outside diameter of the heat pipes are configured in such a manner that the heat pipes 6 are connected with the piston head 10 by means of a pressure fit or by means of a solder or weld connection, also a friction-weld connection.

It lies within the framework of the invention that the bores 5 for accommodating the heat pipes 6 can be disposed not only in a progression parallel to the piston axis A, but also at an incline to the piston axis, depending on the configuration of the combustion bowl, i.e. the wall thickness between combustion bowl 2 and cooling channel 7 (not shown), so that the evaporator side 6*a* of the heat pipes forms a wall ridge 9 or directly a part of the wall of the combustion bowl, corresponding to the previous exemplary embodiments, whereby the condenser side ends in the cooling channel 7.

REFERENCE SYMBOLS

| | |
|---|---|
| piston head | 10 |
| piston crown | 1 |
| combustion bowl | 2 |
| ring belt | 3 |
| ring wall | 4 |
| bores | |
| for heat pipes | 5 |
| heat pipe | 6 |
| evaporator side | 6a |
| condenser side | 6b |
| heat pipe head part | |
| conical | 6c |
| cylindrical | 6d |
| connection seam | 6e |
| heat pipe lower part | 6f |
| coolant | 6g |
| cooling channel | 7 |
| cooling channel cover | 8 |
| wall ridge | 9 |
| piston axis | A |

The invention claimed is:

1. A cooling channel piston for an internal combustion engine, comprising:

a piston head forged from steel, said piston head comprising:

(a) a combustion bowl in a piston crown;

(b) a ring wall with ring belt; and (c) a cooling channel that runs on a circumference of the piston head at a height of the ring belt and having a plurality of bores distributed over a circumference of the cooling channel, said bores being directed towards the piston crown;

a cover for closing off the cooling channel;

pin bosses suspended on the piston head;

a piston skirt connected with the pin bosses; and liquid-filled heat pipes, each pipe having an evaporator side and condenser side, said pipes being disposed in the bores of the cooling channel, wherein the evaporator sides of the heat pipes end at a piston-crown-side end of the bores, and the condenser sides of the heat pipes end in the cooling channel, and wherein the bores have a bore depth ($B_T$) that ends before the piston crown, so that a wall ridge of piston material exists between the evaporator sides of the heat pipes and the piston crown.

2. The cooling channel piston for an internal combustion engine, according to claim 1, wherein the bores have a bore depth ($B_T$) that extends all the way to the piston crown so that one of the evaporator sides of the heat pipes form a part of the piston crown.

3. The cooling channel piston for an internal combustion engine, according to claim 1, wherein the heat pipes are disposed in a region of impact of combustion jets.

4. The cooling channel piston for an internal combustion engine, according to claim 1, wherein the condenser sides of the heat pipes are guided through the cover of the cooling channel.

5. The cooling channel piston for an internal combustion engine, according to claim 4, wherein the condenser side of the heat pipes has cooling oil applied to it from a nozzle disposed in the engine chamber.

6. The cooling channel piston for an internal combustion engine, according to claim 1, wherein the heat pipes introduced into the bores are unreleasably connected with the piston head by means of a solder connection, weld connection, or glue connection, or by means of a pressure fit.

7. The cooling channel piston for an internal combustion engine, according to claim 1, wherein the heat pipes consist of a cylindrical or conical head part and a cylindrical lower heat pipe part, which are unreleasably connected with one another.

8. The cooling channel piston for an internal combustion engine, according to claim 1, wherein axes of the bores run parallel to a piston axis (A).

* * * * *